US008128274B2

(12) United States Patent
Chien

(10) Patent No.: US 8,128,274 B2
(45) Date of Patent: Mar. 6, 2012

(54) LED NIGHT LIGHT WITH PROJECTION FEATURE

(76) Inventor: Tseng-Lu Chien, Shi-Chi Town (TW)

( * ) Notice: Subject to any disclaimer, the term of this patent is extended or adjusted under 35 U.S.C. 154(b) by 0 days.

(21) Appl. No.: 12/907,443

(22) Filed: Oct. 19, 2010

(65) Prior Publication Data

US 2011/0090470 A1 Apr. 21, 2011

Related U.S. Application Data

(62) Division of application No. 12/232,505, filed on Sep. 18, 2008, now Pat. No. 7,832,917.

(51) Int. Cl.
*H01R 33/00* (2006.01)

(52) U.S. Cl. ..... 362/641; 362/642; 362/644

(58) Field of Classification Search ..... 362/641–644, 362/800, 276, 295, 394; 353/22–24, 34, 353/71, 119

See application file for complete search history.

(56) References Cited

U.S. PATENT DOCUMENTS

| | | | | |
|---|---|---|---|---|
| 5,517,264 | A * | 5/1996 | Sutton | 353/71 |
| 5,926,440 | A * | 7/1999 | Chien | 362/641 |
| 7,267,444 | B2 * | 9/2007 | Black, Jr. | 353/79 |
| 7,329,035 | B2 * | 2/2008 | Feliciano | 362/644 |
| 7,419,294 | B2 * | 9/2008 | Lai | 362/641 |
| 7,478,912 | B2 * | 1/2009 | Black, Jr. | 353/70 |
| 7,717,570 | B2 * | 5/2010 | Black, Jr. | 353/70 |
| 7,832,917 | B2 * | 11/2010 | Chien | 362/641 |

* cited by examiner

*Primary Examiner* — Bao Q Truong
(74) *Attorney, Agent, or Firm* — Bacon & Thomas, PLLC

(57) ABSTRACT

An LED night light for night time or dark area use may be arranged as a plug-in wall outlet night light or a direct current that includes projection features to project an image, message, data, logo, and/or time on a ceiling, walls, floor, or other desired surface. The LED night light incorporates optics selected from an optics-lens, convex lens, concave lens, openings, cut-outs, film, grating means, and/or hologram means to create the preferred image and project it to a desired location.

2 Claims, 6 Drawing Sheets

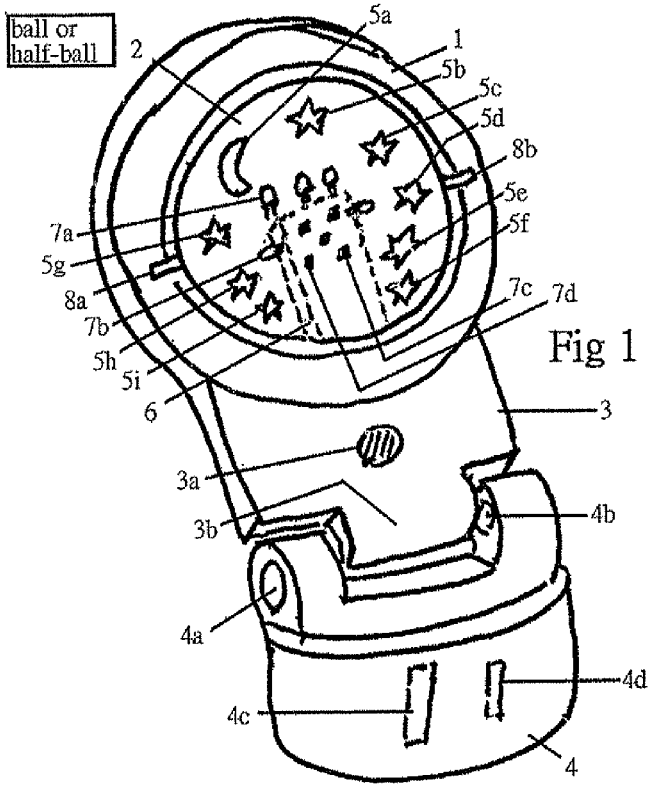
Fig 1
Fig 2
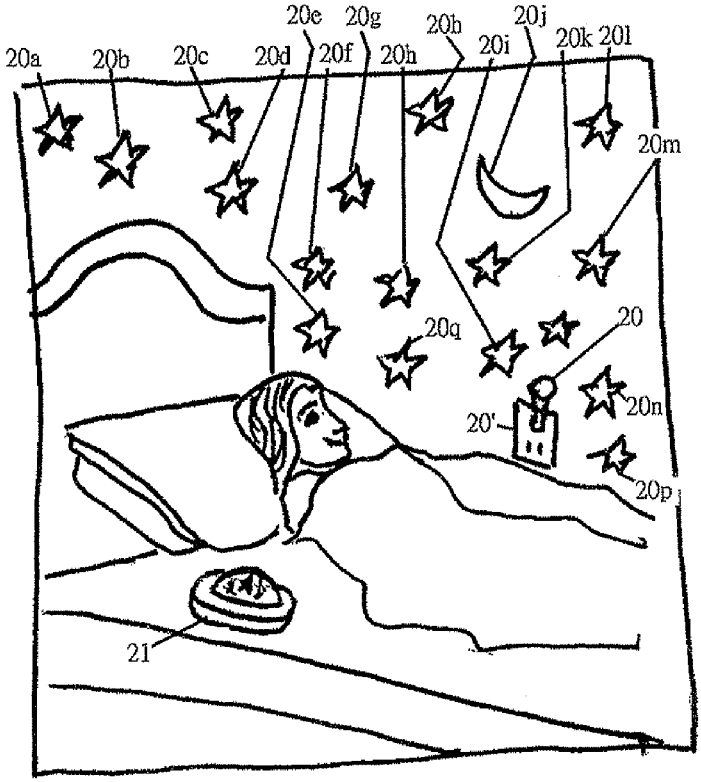

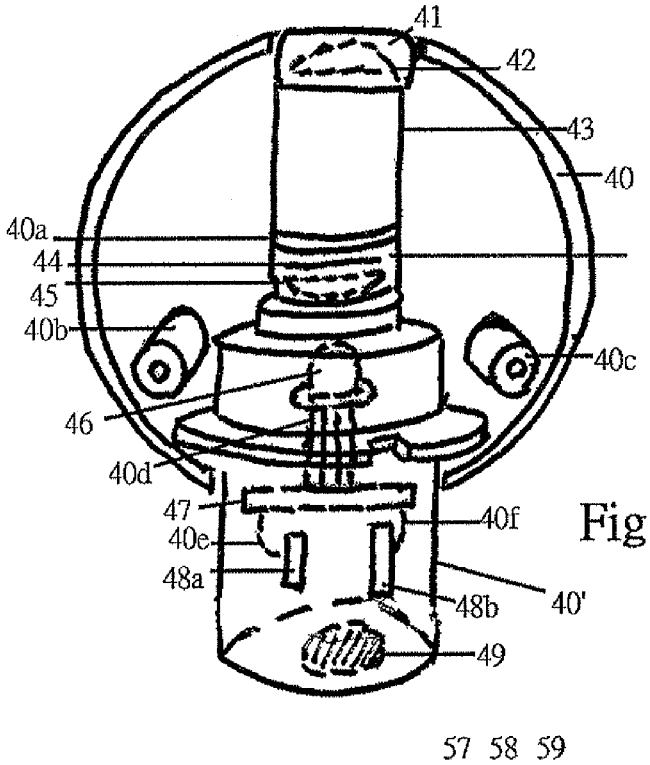
Fig 4
Fig 5
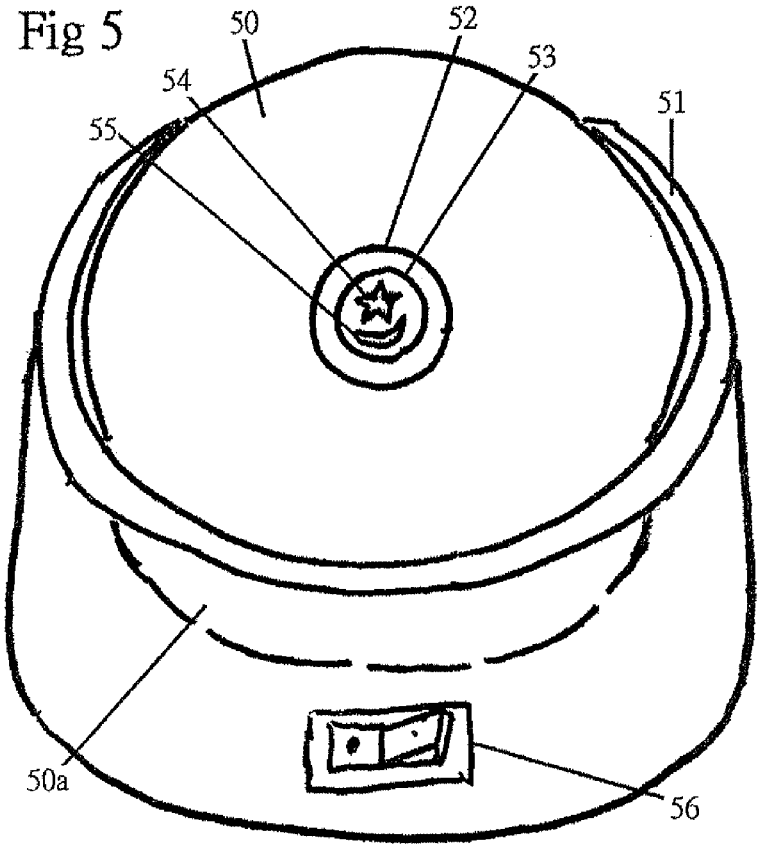

Fig 6
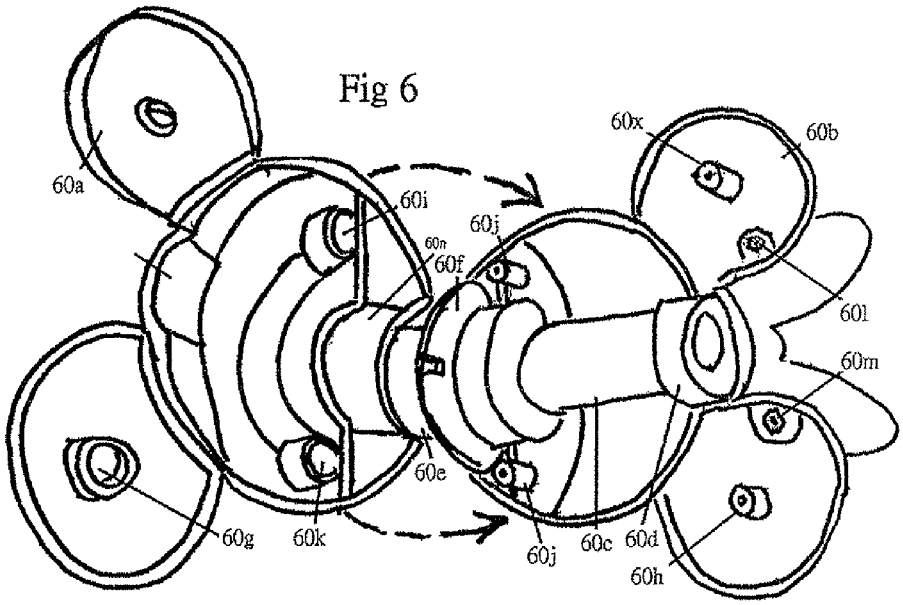
Fig 7
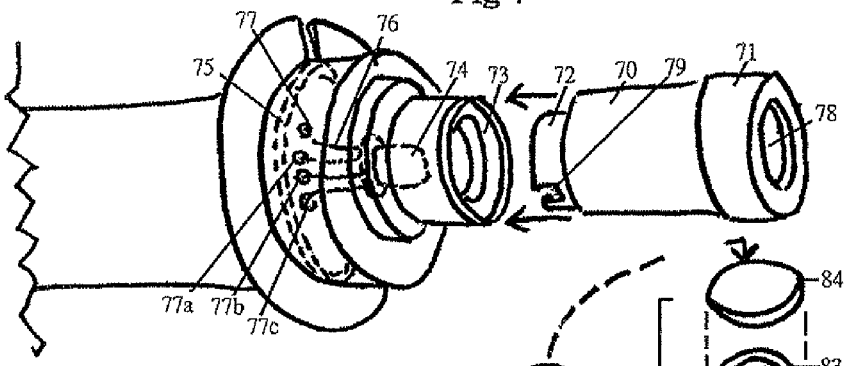
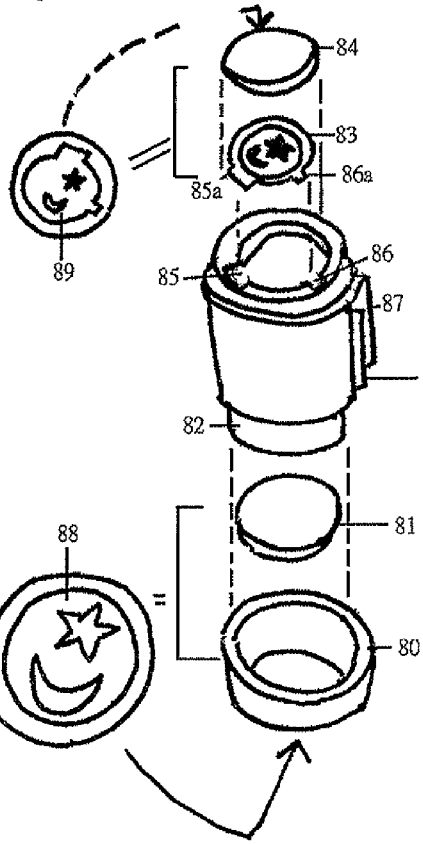
Fig 8

LED NIGHT LIGHT WITH PROJECTION FEATURE

This application is a divisional of U.S. patent application Ser. No. 12/232,505, filed Sep. 18, 2008, now U.S. Pat. No. 7,832,917 and now allowed.

This application has subject matter in common with U.S. patent application Ser. No. 12/149,963 ("Removable LED light device"); Ser. No. 12/073,889; ("LED track light device"); Ser. No. 12/073,095 ("LED light with changeable position with Preferable power source"); Ser. No. 12/007,076 ("LED light with changeable geometric system"); Ser. No. 12/003,691 ("LED light with changeable geometric dimension features"); Ser. No. 12/003,809 ("LED light with changeable features"); Ser. No. 11/806,711 ("Multiple LED light with adjustable angle features"); Ser. No. 11/527,631 ("LED Night light with interchangeable display unit") Ser. No. 11/498,881 ("Poly Night light"); Ser. No. 11/255,981 ("Multiple light source Night Light") Ser. No. 11/092,741 ("LED Night light with Liquid optics medium"); Ser. No. 11/092,741 ("Night light with fiber optics"); Ser. No. 10/498,874 ("Fiber Optic light kits for footwear"); Ser. No. 11/498,874 ("Area Illumination for LED night light"); Ser. No. 11/527,629 ("Time Piece with LED night light"); Ser. No. 11/527,628 ("Multiple Function Night light with Air Freshener"); Ser. No. 11/806,284 ("LED Night light with more than one optics mediums"); Ser. No. 11/806,285 ("LED Night Light with multiple function"); and Ser. No. 11/806,711 ("Multiple LEDs Light with adjustable angle function").

BACKGROUND OF THE INVENTION

The current invention can be used to project a light image to a desired location on a wall or ceiling to enable people to view an image such as stars, the moon, a planet, a silver-river, or another universal image that induces a pleasant mood in the dark and helps people fall a sleep in a nice environment. This is especially important for youth or kid's room applications because it allows the youth or kid to have their own favorite image surround them.

The current invention includes LED light for night time use, which is provided in a plug-in wall outlet night light or direct current (hereafter as DC) operated night light with projection features to project an image, message, data, logo, or time on a ceiling, walls, floor, or other desired surface.

As in copending allowed U.S. patent application Ser. No. 11/255,981, the current invention may use multiple LEDs as a light source to emit visible light beams that pass through one or more optics means as in co-pending U.S. patent application Ser. No. 11/806,284 and create an image at a desired location with preferred characteristics such as size, dimension, area, height, distance, color, brightness, time period, and/or trigger means.

The current invention may incorporate preferred optics means such as an optics-lens, concave lens, openings, cut-outs, films, grating means, and/or hologram means (such as the one disclosed in the inventor's U.S. Pat. No. 5,667,736) to create the preferred image at a desired location that is visible to the viewer.

The current invention thus combines various principles disclosed in the inventor's co-pending U.S. patent application Ser. Nos. 11/255,981 and 11/806,284 for more than one light source and optics means with the grating or hologram disclosed in the inventor's U.S. Pat. No. 5,667,736 to create a lot of images and get the best image projection on a wall, ceiling, or floor.

BRIEF DESCRIPTION OF THE DRAWINGS

FIGS. 1-2 and 1-3 show second and fourth preferred embodiments of the invention, in the form of a direct current (DC) operated LED night light with different optics means selected from openings, cut-outs, transparent or translucent optics means, grating means, hologram means, and/or films to project desired images to a desired location.

FIG. 4 illustrates details of the construction of the third preferred embodiment, which takes the form of a plug-in type of night light with a convex-lens assembly and film that serve as optics means to project the desired image.

FIG. 5 illustrates an alternative construction for the night light of FIG. 4, in which the convex-lens assembly is installed into a ball-unit whose position can be changed as required to project the image to a desired location and which includes a preferred trigger-means.

FIG. 6 illustrates another alternative construction for the night light of FIG. 4, which has a housing arranged to provide the night light with an attractive shape.

FIGS. 7 and 8 illustrate an optics means for the embodiments of FIGS. 1, 4, 5, and 6, in the form of a convex-lens assembly with a desired image film, the convex-lens assembly creating an image whose size is different when viewed from the two ends of the convex-lens assembly.

DETAILED DESCRIPTION OF THE PREFERRED EMBODIMENTS

The LED night light with projection features of current invention differs from a conventional projection pen, projection key chain, projection toy, or commercial presentation projection equipment. It may be used for night light applications with LED or LEDs as a light source and in which the night light is arranged to directly plug into an outlet device, so the circuit needs to be a special design to utilize AC 110V 60 Hz input power to drive the LED or LEDs. The invention may also be applied to direct current (DC) operated night lights, including one in which to turn the LED or LEDs are turned on by pushing an optics-lens in a manner similar to that employed to turn on a conventional puck light However, the current invention provides big improvements over the conventional puck light by adding an optics design to the opaque lens of the conventional puck light. The optics means of the current invention may in general be selected from the group including but not limited to an optics-lens, convex lens, concave lens, telescope, film, grating means, hologram means, transparent material, translucent material, openings, and cut-outs with precision optics calculation and optics design to cause an image such as a message, logo, characters, sign, time, or date to be projected on a desired surface such as a ceiling, walls, floor, or any other desired location.

While the current invention offers a preferred geometric design for the whole night light, it is not limited to the preferred embodiments. Alternative constructions for the night light, such as constructions that enable the night light to tilt, swivel, rotate, change position, and/or adjust focus still fall within the current invention scope.

Figures 1, 2:
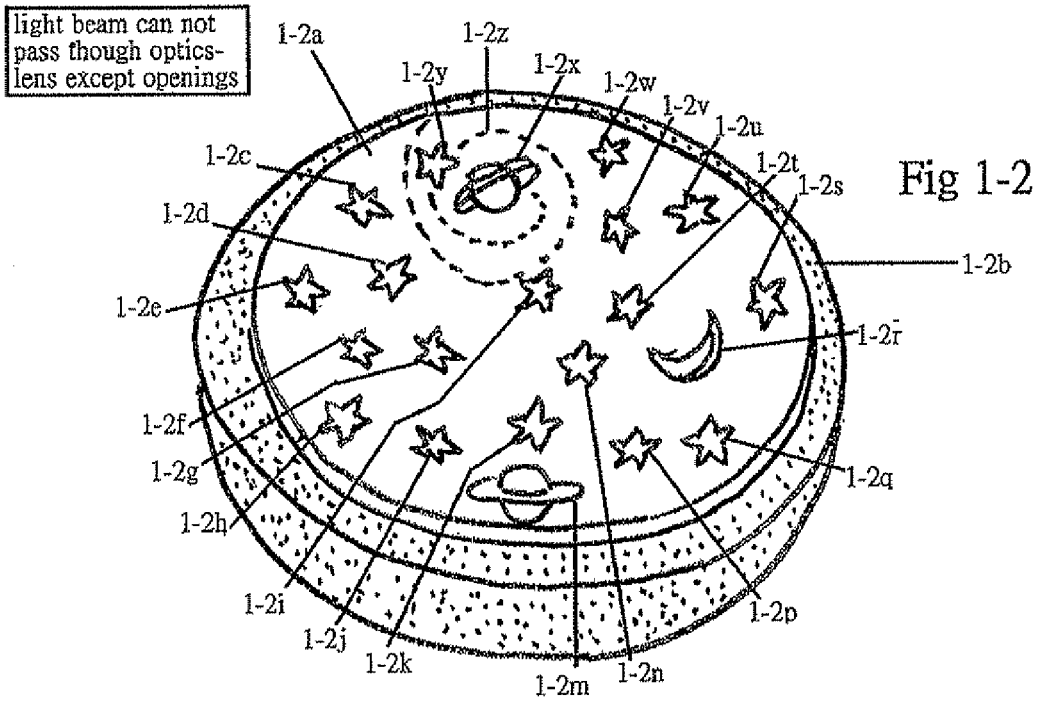
FIGS. 1 and 3 respectively show first and third preferred embodiments of an LED night light with image projection function. These preferred night lights are plug-in type night lights arranged to connect with an electric outlet. The night light of FIG. 1 utilizes an opening, cutout, and/or transparent or translucent optics means to create the image. The night light of FIG. 3 items utilizes a convex-lens assembly and film as optics means to create an image with a position change feature.
FIG. 2 shows an example of an image projected, according to the current invention, on a wall, ceiling, or floor of a living place by a plug-in type night light or battery operated LED night light.

FIG. 1 shows an LED night light with a top housing (1) to hold a ball-shaped optics-means or lens (2). The ball-shaped optics-means (2) has a lot of openings (5*a* to 5*i*) with desired shapes, such as moon (5*a*), stars (5*b* to 5*i*), and/or planets (not shown). Each opening's size and shape are designed to allow light beams emitted by the inner LED or LEDs (7*a* to 7*d*) to pass through these openings (5*a* to 5*i*) to form a clear and nice image on the desired surface. The image may be projected on surfaces with different distances or heights so that the optics design of the light source relative to the openings need to carefully considered so the image will be very clear on the desired surface.

The optics-lens (2) of FIG. 1 may have a ball shape, half-ball shape, or an approximately spherical surface to enable more images to be shown in a three-dimensional space. However, an alternative geometric shape still can be applied to the current invention so long as it provides acceptable image performance. Any alternative shape of the optics-means may still fall within the current invention scope, as may different ranges of projection area.

As shown in FIG. 1, the LED or LEDs (7*a* to 7*d*) are arranged on a circuit-means (6) which has electric parts and accessories to enable the incoming electric signal to drive the LED or LEDs by supplying an appropriate working voltage and frequency using electric components incorporated in the circuit-means (6), and thereby get a desired light function, the electric components including by way of example an IC, sensor-means, switch-means, timer, resistor, capacitor and/or any conventional market available parts and accessories.

Also as shown in FIG. 1, the base housing (4) can be assembled with the top housing (1) by attachment-means from end (4*c*) to end (4*d*) so as to enable the top housing (1) to swivel to the base housing (4). The base housing includes prong means (4*a*) (4*b*) to connect with the outlet device and can also be designed as a swivel type as wished.

FIG. 2 illustrates the function of LED night lights (20) (21) with projection features. The plug-in night light (20) plugs into a wall outlet to project an image on a desired location such as a ceiling, walls, or floor. The direct current (DC) operated LED night light (21) is able to project an image to any desired location.

As shown in FIGS. 1 and 2, the direct current (DC) operated LED night light includes an optics-lens (1-2*a*) installed on the base (1-2*b*). The optics-lens (1-2*a*) has an appropriate optics design to allow the inner LED or LEDs' light beam to pass though the optics-means and create an image, logo, sign, data, or message for display on a desired surface. The optics-lens (1-2*a*) has a sphere shape which only allows the light to pass through the optics-lens (1-2*a*) via openings (1-2*a* to 1-2*z*). The distance between the inner light source and outside openings, LED viewing angle, and opening sizes are selected to enable the LED or LEDs' light beam to pass through the openings and provide a clear image on the desired surface. The openings (1-2*a* to 1-2*z*) can be any shape, such as stars (1-2*c* to 1-2*k*), a moon (1-2*r*), a planet (1-2*x*) (1-2*m*), a silver-river (1-2*z*), and so forth.

Figures 1, 2, 3:
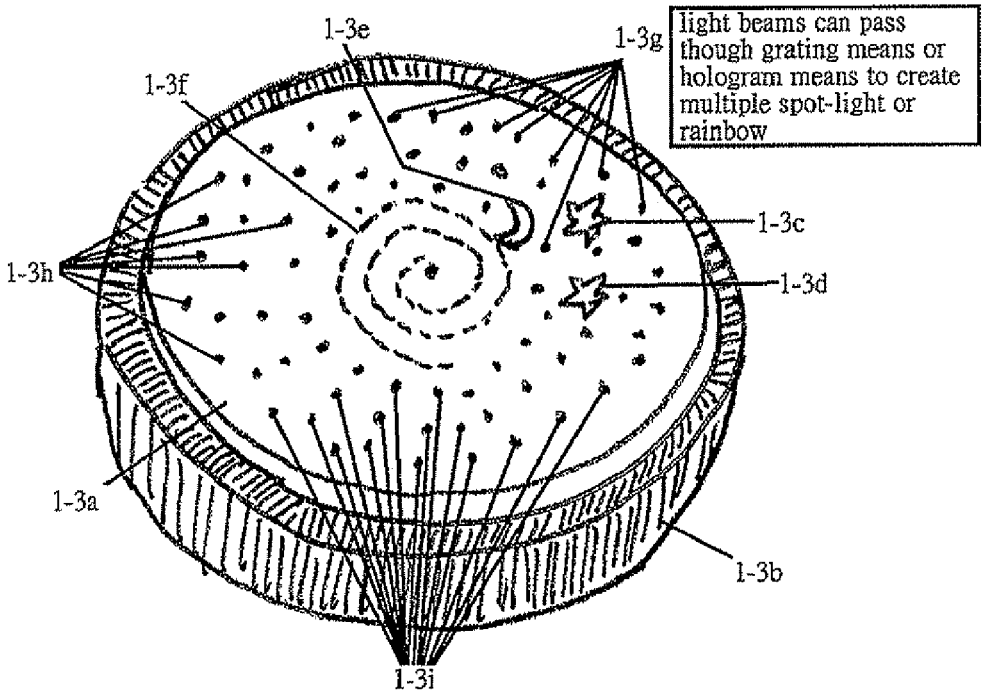
Figure 3:
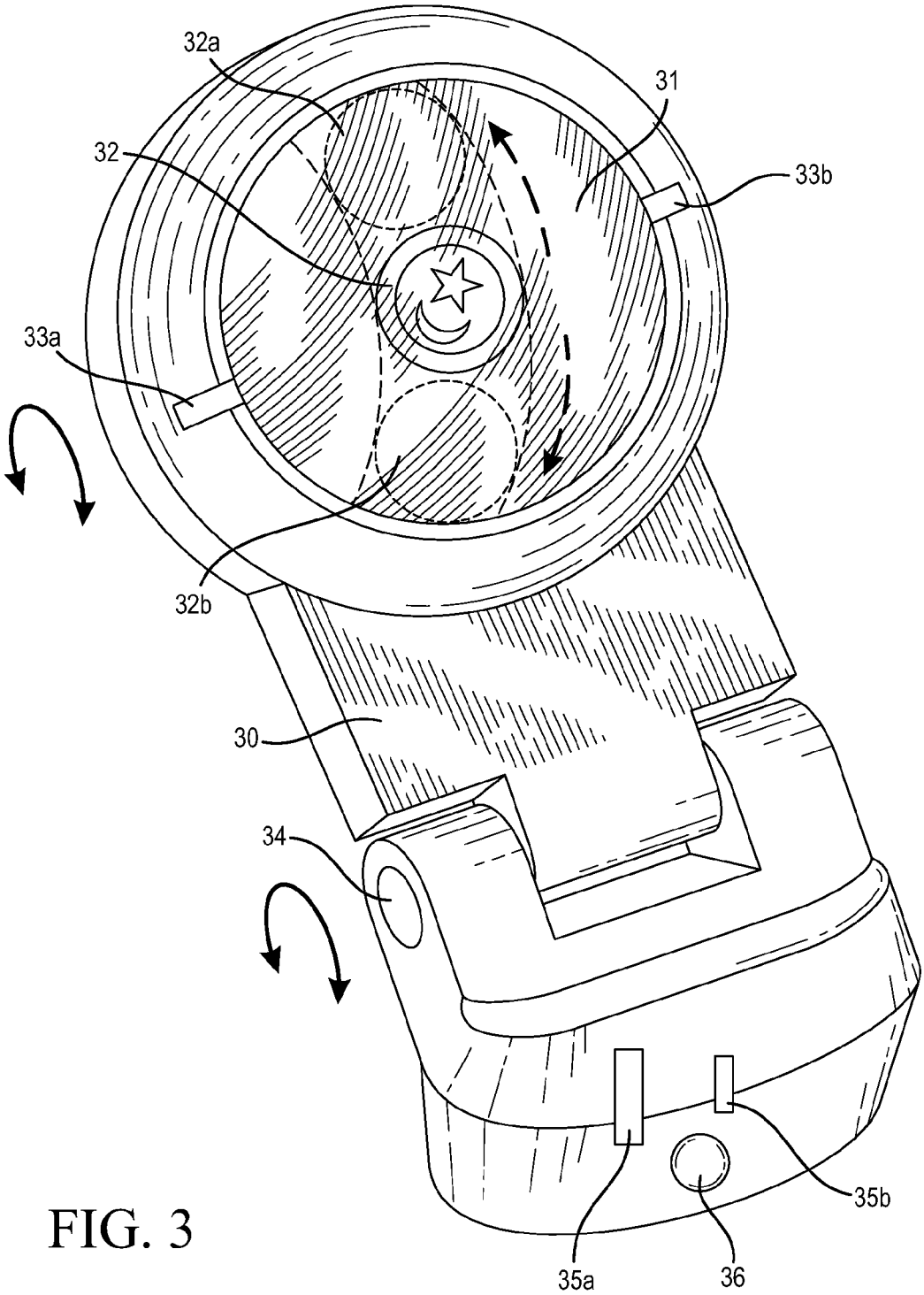

FIG. 1-3 shows a direct current (DC) operated LED night light having an optics-lens (1-3*a*) installed on the base (1-3*b*). The optics-lens has an appropriate design to allow the inner LED or LEDs' light beam to pass though the optics-means and create an image, logo, sign, data, or message display on a desired surface. The optics-lens (1-3*a*) has a sphere shape and is arranged to permit the light to pass anywhere through the optics-lens because the optics-lens incorporates a grating or hologram means that causes the limited LED or LEDs light points to form multiple light-spots (1-3*h*) (1-3*i*) or rainbow-effects (not shown) on the whole surface and project an image having the desired effects to desired surfaces. The optics-lens (1-3*a*) is made by an injection-process such as the one disclosed in the inventor's U.S. Pat. No. 5,667,736. The optics-lens alternatively can be any type of transparent or translucent lens incorporating a grating or hologram film to generate the multiple light-spots (1-3*h*) (1-3*i*) or rainbow-effects (not shown) on the lens and project an image to a desired surface with those effects. This will enable kids or youth to enjoy the mood created by the images projected by the DC operated night light with projection effects in dark environment.

As shown in FIG. 3, the LED night light with projection feature has a top housing (30) with a ball-shaped optics-lens (31), with two poles (33*a*) (33*b*) to allow the ball (31) to rotate and thereby change the projection position from an initial position such as position (32) to positions (32*a*) or (32*b*). This feature may be included even when the plug-in night light is not a swivel-housing design, although the night light illustrated in FIG. 3 does utilize a swivel-housing design night light incorporated with optics-means by optics-lens assembly. The swivel-housing is joined with top housing (30) and base housing (34) by attachment-means to obtain the top housing (30) that can be swiveled to a desired position when plugged into a wall outlet. Also as shown in FIG. 3, the LED night light with projection features has a prong means (35*a*) (35*b*) and sensor means (36) that causes the light to automatically turn on when the brightness of the environment has dropped to a predetermined level.

FIG. 4 shows a ball-shaped night light (40) having an optics-lens assembly which includes convex lens (42) installed within the telescope body (43) and held by cover (41) at a top portion of the telescope body. The other end of the telescope body (43) has an image film (44) and convex lens (45) clipped tightly in a position that allows a light beam from LED (46) to pass through the convex lens (45) and image film (44) and along the telescope length (43) to convex lens (41) magnify the image shown on the desired surface. The telescope (43) therefore has an optics-lens assembly (45) (44) whose main purpose is to enlarge the tiny size image on the film (44) and project a big image to the desired surface. The telescope construction can be modified by making it 'focus adjustable" in order to obtain a clearer image. Such a modification provides a deluxe model that will still fall within the scope of the current invention.

The LED or LEDs (46) are connected by circuit means that may have a variety of electric components selected from any combination of conductive means (40*e*) (40*f*), a circuit board (47), an integrated circuit (hereafter as IC), sensor means, switch means, a motion sensor, a timer, a photo sensor (49), resilient conductive means, or other electric components selected from conventional available parts or accessories. These electric components can be arranged to provide the LED or LEDs with desired light functions and light performance in a manner similar to other LED light devices available in the marketplace.

The principles of the LED night light with projection features of FIG. 4, which utilizes an optics-lens assembly and telescope means to project a tiny image on a film to a big surface, can also be applied to the night light of FIG. 3, in which case the telescope means can change position when the ball is rotated to change the image projection direction to a different direction.

FIG. 5 disclosure shows an alternative construction of a full ball (50) having telescope means (53) and an optics-lens assembly (not shown) inside of the ball. The direction of the telescope (53) can be changed when the ball (50) is rotated to another direction. The image of star (54) and moon (55) can thus be projected to a desired surface for a much larger image. In addition, the focus can be adjusted by twisting the front cover to change the length of the telescope and provide a clearer image.

FIG. 6 shows a telescope means (60*c*) and optics-lens assembly (60*d*) inside two half housings (60*a*) (60*b*). The two housing halves (60*a*) (60*b*) are assembled together by a screw through the poles (60*j*') (60*j*) and holder (60*i*) (60*k*).

FIG. 7 shows details of the construction of a telescope (70) with a top portion (71) having a convex lens (78) inside. The other end (72) of the telescope (70) has a film (not shown) and convex lens (not shown) clipped tightly at a location that enables the tiny image on the film to become a large image on the top of the telescope. The end (72) is inserted into the receiving end (73) so the LED light beam can be input to the telescope and projected to the desired surface. The LED (74) is installed on an inner circuit-means and connected with a preferred power source from an outlet or batteries to cause the LED to turn on according to a predetermined time, function, duration, and effects.

FIG. 8 shows details of the construction of a telescope (87) which has a top cover (80) to hold a convex lens (81) in position. The other end of telescope (87) has two notches (85) (86) to hold a film's two projecting ends (85*a*) (86*a*) and thereby hold the film without any deviation in position. The small convex-lens (84) is clipped tight on the telescope. The image seen from the small end of telescope is a tiny image (89). The image seen from the front of the telescope is a very large image (88) because the telescope enlarges the tiny image to the bigger size.

Figure 9:
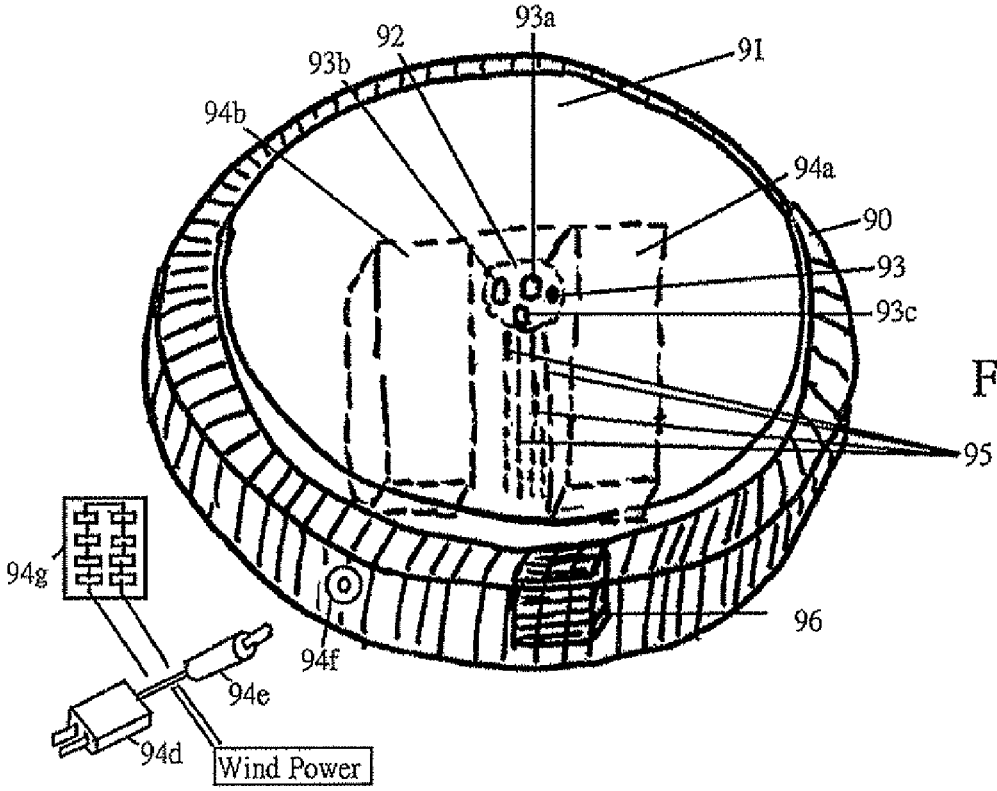
FIG. 9 a light source, power source, circuit means, and trigger means for a battery operated night light device.
Figure 10:
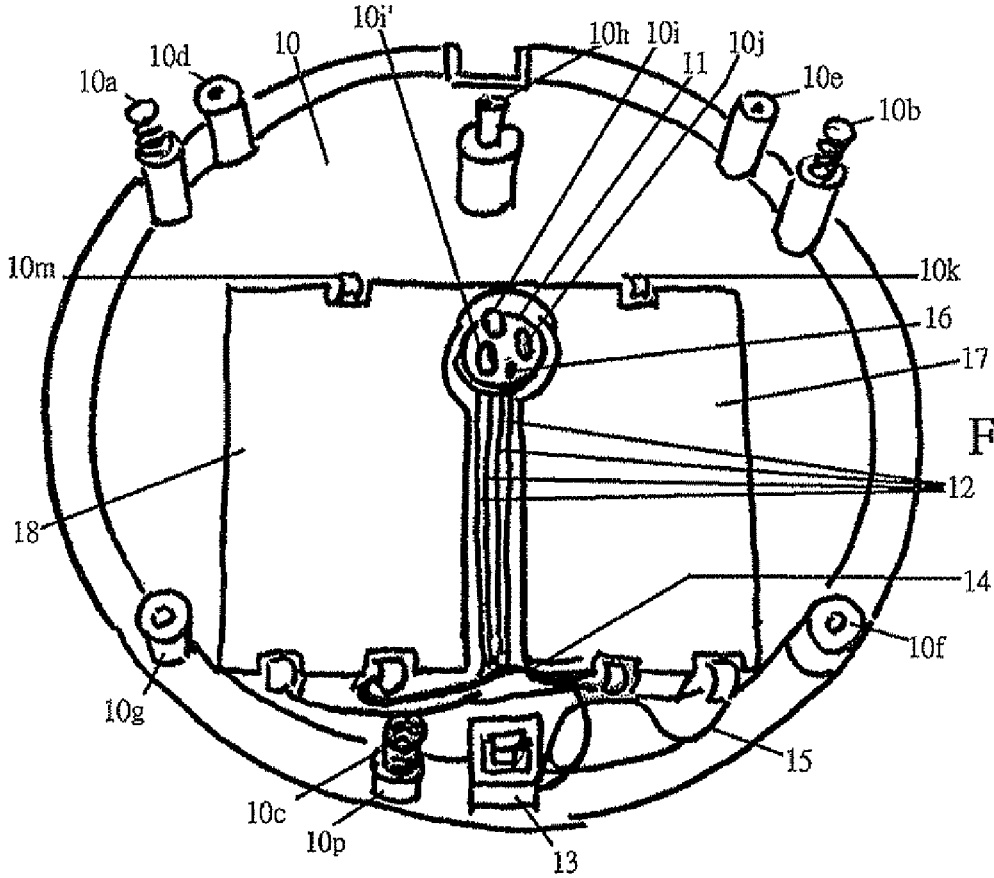
FIG. 10 illustrates details of the construction of a preferred direct current operated night light with touch top optics means to turn on the light and an optional timer-means to provide illumination for a certain time period and automatic turn-off, and which can also include a motion sensor or photo sensor means to be selected as required.

FIG. 9 shows a DC operated night light device and its electric components and an optics-means (91) on top of the base (90). The interior construction includes power source compartments (94*a*) (94*b*) which may have three batteries in each compartment to supply a voltage of approximately 4.5 Volt, although different power source arrangement may also be provided, including arrangement utilizing different voltages (3V, 6V, 9V, 12V, 24 v), different DC power sources, solar power (94*g*), a generator, wind power, chemical power, at least one alkaline battery, at least one rechargeable battery, an AC adaptor (94*d*) (94*e*) with adaptor jack (94*e*), and/or AC power (94*c*).

In the light device of FIG. 9, the LED or LEDs (93*a*) (93*b*) (93*c*) are connected with circuit-means such as, by way of example and not limitation, a circuit board (92), integrated circuit (93), conductive means (95), switch means (96), AC jack (94*f*), solar module (94*g*), AC plug and wire (94*c*), AC adaptor (94*d*), sensor means, motion sensor means, and/or timer means to provide desired light functions and effects.

For example, FIG. 9 illustrates that the DC operated night light circuit arrangement has a switch means (13) located at a position under the edge of the optic-lens (not shown). When the optic-lens is pushed, the switch will turn on the LED or LEDs to provide illumination according to predetermined functions and periods of time. The LED or LEDs are incorporated with the circuit means to get the desired functions. Spring means (10*a*) (10*b*) (10*c*) offer resilient properties to enable the optics-lens to be pushed down and to return back to the original position after the next push. The integrated circuit (16) is an IC Chip which can offer a lot of functions selected from conventionally available light functions.

While the above-discussed preferred embodiments show the scope of the current invention, it will be appreciated that any alternative or equivalent functions of design, construction, modification, and/or up-grade will still fall within the scope of the invention, which is not limited to the above-discussed and mentioned details. Any alternative or equivalent arrangement, process, installation, design, or the like may still fall within the scope of the current invention, including variations in the power source, conductive means, geometric shape of LED-units, joint-means, circuit means, sensor means, switch means, LED elements, attachment means, fixing-means, tightening means, and/or resilient conductive means.

The invention claimed is:

1. A night light with projection features, comprising:

at least one LED arranged as a light source to supply visible light beams;

at least one optics means for projecting an image on a desired surface, said optics means selected from the group consisting of an optics lens, a concave or convex lens, a telescope means, a film, openings, a display unit, a changeable LCD display unit, a changeable image unit, cut outs, a transparent material, a translucent material, grating means, and hologram means, said image being formed by light from said at least one LED passing through transparent areas, openings, cut outs, grating means, or hologram means, said image being selected from the group consisting of a message, data, a logo, a time, a moving image, an automatically changing image, a cartoon, a motion picture, and any other image desired to be projected on said desired surface, and said desired surface selected from the group consisting of a ceiling, a wall, a floor, and any other surface; and at least one power source, circuit means, and trigger means arranged to cause said at least one LED to exhibit desired light functions, timing, colors, brightness, and illumination, the improvement wherein:

said night light includes both a night light for illumination in a dark environment and a projection image light combined in one unit with a power source selected from the group consisting of batteries, an adaptor, a transformer, electric wires with a plug to an outlet, USB power, an adaptor with a jack, a solar power source, a chemical power source, a wind power source, and any other direct current power source or energy storage device, and said projection image light had additional angle, position, or orientation adjustment features that enable adjustment of the projection image light in any of three dimensions to cause the image to be projected to a desired position.

2. A night light with projection features, comprising:

at least one LED arranged as a light source to supply visible light beams;

at least one optics means for projecting an image on a desired surface, said optics means selected from the group consisting of an optics lens, a concave or convex lens, a telescope means, a film, openings, a display unit, cut outs, a transparent material, a translucent material, grating means, and hologram means, said image being formed by light from said at least one LED passing through transparent areas, openings, cut outs, grating means, or hologram means, said image being selected from the group consisting of a message, data, a logo, a time, and any other image desired to be projected on said desired surface, and said desired surface selected from the group consisting of a ceiling, a wall, a floor, and any other surface outside said night light; and at least one power source, circuit means, and trigger means arranged to cause said at least one LED to exhibit desired light functions, timing, colors, brightness, and illumination, the improvement wherein:

said night light with projection features is a direct current night light and said optics means includes at least said optics lens, said night light being arranged to turn on when said optics lens is touched or pushed, and said direct current power source supplying an electric signal to said at least one LED from a power source selected from the group consisting of an AC adaptor with a jack, a solar power source, a chemical power source, a generator, and any other direct current power source.

* * * * *